US005108522A

United States Patent [19]

Nishimoto et al.

[11] Patent Number: 5,108,522

[45] Date of Patent: Apr. 28, 1992

[54] METHOD OF MAKING NON-ORIENTED ELECTRICAL STEEL SHEETS HAVING EXCELLENT MAGNETIC PROPERTIES UNDER LOW MAGNETIC FIELD

[75] Inventors: Akihiko Nishimoto; Yoshihara Hosoya; Kunikazu Tomita; Toshiaki Urabe; Masaharu Jitsukawa, all of Tokyo, Japan

[73] Assignee: NKK Corporation, Tokyo, Japan

[21] Appl. No.: 425,183

[22] PCT Filed: Mar. 3, 1989

[86] PCT No.: PCT/JP89/00233

§ 371 Date: Oct. 12, 1989

§ 102(e) Date: Oct. 12, 1989

[87] PCT Pub. No.: WO89/08152

PCT Pub. Date: Sep. 8, 1989

[30] Foreign Application Priority Data

Mar. 4, 1988 [JP] Japan ..... 63-49577

[51] Int. Cl.[5] ..... H01F 1/04

[52] U.S. Cl. ..... 148/111

[58] Field of Search ..... 148/110, 111, 112, 113

[56] References Cited

U.S. PATENT DOCUMENTS 3,770,517 11/1973 Gray et al. ..... 148/111

3,948,691 4/1976 Matsushita et al. ..... 148/112

FOREIGN PATENT DOCUMENTS 63-137122 6/1988 Japan .

63-255323 10/1988 Japan .

*Primary Examiner*—John P. Sheehan

*Attorney, Agent, or Firm*—Nields & Lemack

[57] ABSTRACT

The present invention is to produce non-oriented electrical steel sheets having excellent magnetic property under low magnetic field by effectively checking thermal stress from introducing during cooling in a final annealing without decreasing productivity, for which when a silicon steel sheet having passed a cold rolling is cooled after a final continuous annealing, especial cooling conditions are specified only to a temperature range giving bad influences to the magnetic properties under the low magnetic field so as to prevent the introduction of the thermal strain.

1 Claim, 4 Drawing Sheets

○ ΔB3 : Changing amount (T) of B3 for condition of $v_1$ = 3°C/s
Δh : Changing amount (%) of steep degree for condition of $v_1$ = 3°C/s

○ $T_Q$ = 600°C

METHOD OF MAKING NON-ORIENTED ELECTRICAL STEEL SHEETS HAVING EXCELLENT MAGNETIC PROPERTIES UNDER LOW MAGNETIC FIELD

TECHNICAL FIELD

This invention relates to a method of making non-oriented electrical steel sheets having excellent magnetic properties under low magnetic field.

BACKGROUND OF THE INVENTION

One characteristic required of electrical steel sheets is the magnetic flux density under a low magnetic field. As for non-oriented electrical steel sheets used as iron cores of motors, this characteristic is an important factor governing the efficiency of motors.

In general, the magnetic properties of the electrical steel sheet under the low magnetic field depend on the movability of the domain walls, and are mainly effected by micro-structures such as grain boundaries, fine precipitates, non-metallic inclusions, lattice defects or internal stresses.

Among them, the grain boundaries (grain diameter), fine precipitates and non-metallic inclusions are preliminarily controlled by birthes of steel themselves, and the lattice defects (strain) and the internal stress are very often introduced by external factors during final annealing.

With respect to external strain factors negatively influencing the magnetic properties under the low magnetic field, the most important factors in processing are strains which are caused by tension in an annealing line, bending deformation by the rolls in a furnace or thermal stress during cooling.

There recently has been heavy demand for thin gauge electrical steel sheets, aiming at low iron loss. In view of the objective of keeping the flatness of the steel sheet and improving its properties under the low magnetic field, slow coolings are indispensable within ranges improving the tension and precision without decreasing the productivity. The method for cooling in a final annealing, taking the magnetic properties into consideration, has been proposed in Japanese Patent Laid-Open Specification No. 96,919/77. This proposal specifies the cooling rate from the soaking temperature to 300° C. at not more than 250° C./min for decreasing the iron loss. However in the annealing of 1000° C. shown in the Example, this technique takes 2.8 minutes for cooling from 1000° to 300° C., and uses a long cooling zone. If the running speed of the strip is made slow, not only does the productivity go down, but also it takes a long time for annealing, so that the magnetic properties (especially iron loss) are sometimes deteriorated reversely by extraordinary grain growth during soaking at the annealing temperature.

DISCLOSURE OF THE INVENTION

In view of the conventional problems as stated above, it is an object of the invention to effectively check the thermal stress introduced into the steel during cooling in the final annealing line without decreasing the production. For accomplishing this object, special cooling conditions have been specified to exclude particular temperature ranges causing deterioration of the magnetic properties under the low magnetic field, whereby the introduction of thermal stress during cooling has been successfully lowered to a level causing practically no inconvenience, without lowering productivity.

That is, the present invention comprises carrying out one cold rolling or plural cold rollings having interposed therebetween an intermediate annealing on a silicon steel sheet to a final thickness, containing not more than 0.02 wt % carbon (C), 1.0 to 4.0 wt % silicon (Si) and 0.01 to 2.0 wt % aluminum (Al), a final continuous annealing at the temperature of 800° to 1100° C., and cooling under the following conditions:

(a) specifying as not more than 8° C./sec, an average cooling rate $v_1$ from a soaking temperature to a range between 620° and 550° C.;

(b) specifying as $v_1 < v_2 \leqq 4v_1$, an average cooling rate $v_2$ from the temperature reached in (a) until a temperature of 300° C.;

with the proviso that the average cooling rate from the soaking temperature to 300° C. is more than 5° C./sec.

The invention carries out one cold rolling or plural cold rollings having interposed therebetween an intermediate annealing on a silicon steel sheet to a final thickness, containing C: not more than 0.02 wt %, Si: 1.0 to 4.0 wt %, and Al: 0.01 to 2.0 wt %, a final continuous annealing at the temperature of 800° to 1100° C., and cooling under the following conditions:

(a) specifying as not more than 8° C./sec, an average cooling rate $v_1$ from a soaking temperature to a range between 620° and 550° C.;

(b) specifying as $v_1 < v_2 \leqq 4v_1$, an average cooling rate $v_2$ from the temperature reached in (a) until a temperature of 300° C.;

with the proviso that the average cooling rate from the soaking temperature to 300° C. is more than 5° C./sec.

Figure 1:
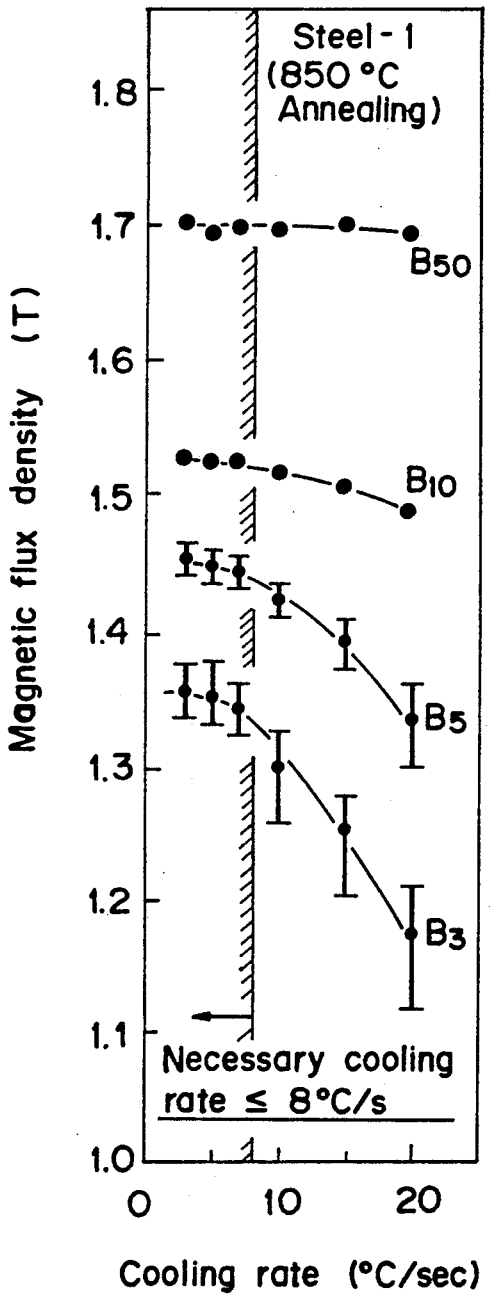
FIG. 1 shows influences of the cooling rate to the magnetic flux density in 1.7 wt % steel; during the final annealing.
Figure 2:
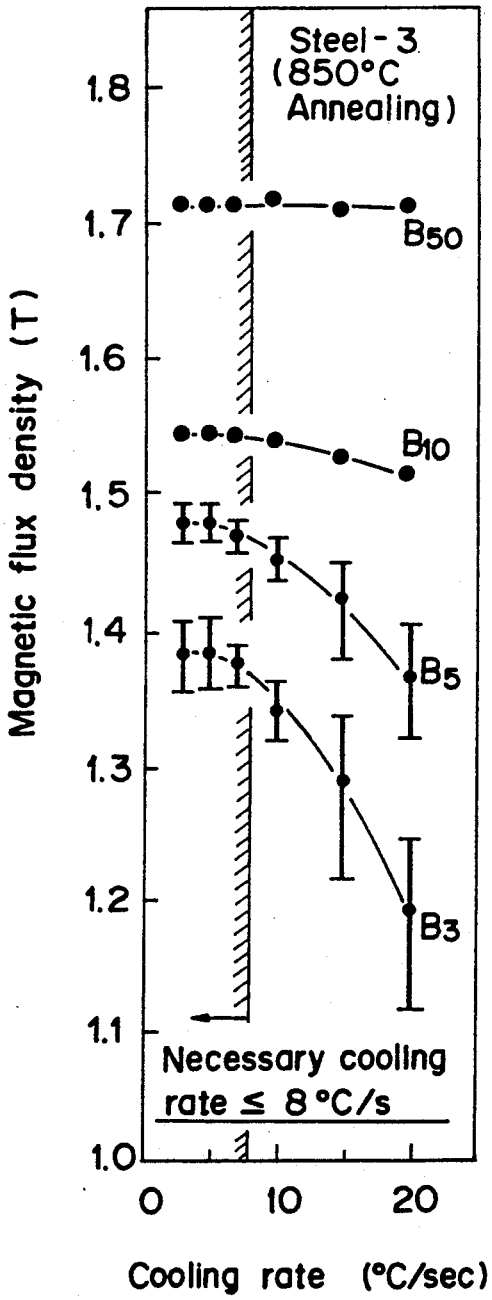
FIG. 2 shows influences of the cooling rate to the magnetic flux density in 3 wt % steel during the final annealing.

When the cooling is performed under the same cooling rate from the soaking temperature and if the cooling rate exceeds 8° C./sec, the magnetic flux density is lowered under the low magnetic field. This is caused by the increase in the internal stress by an abrupt thermal shrinkage. FIGS. 1 and 2 show the influences of the cooling rates during the final annealing on the magnetic flux density in the 1.7% Si steel (Steel 1 in Table 1) and 3% Si steel (Steel 3 in Table 1), respectively, and when the cooling rate exceeds 8° C./sec in the both, the magnetic properties markedly deteriorate.

Figure 3:
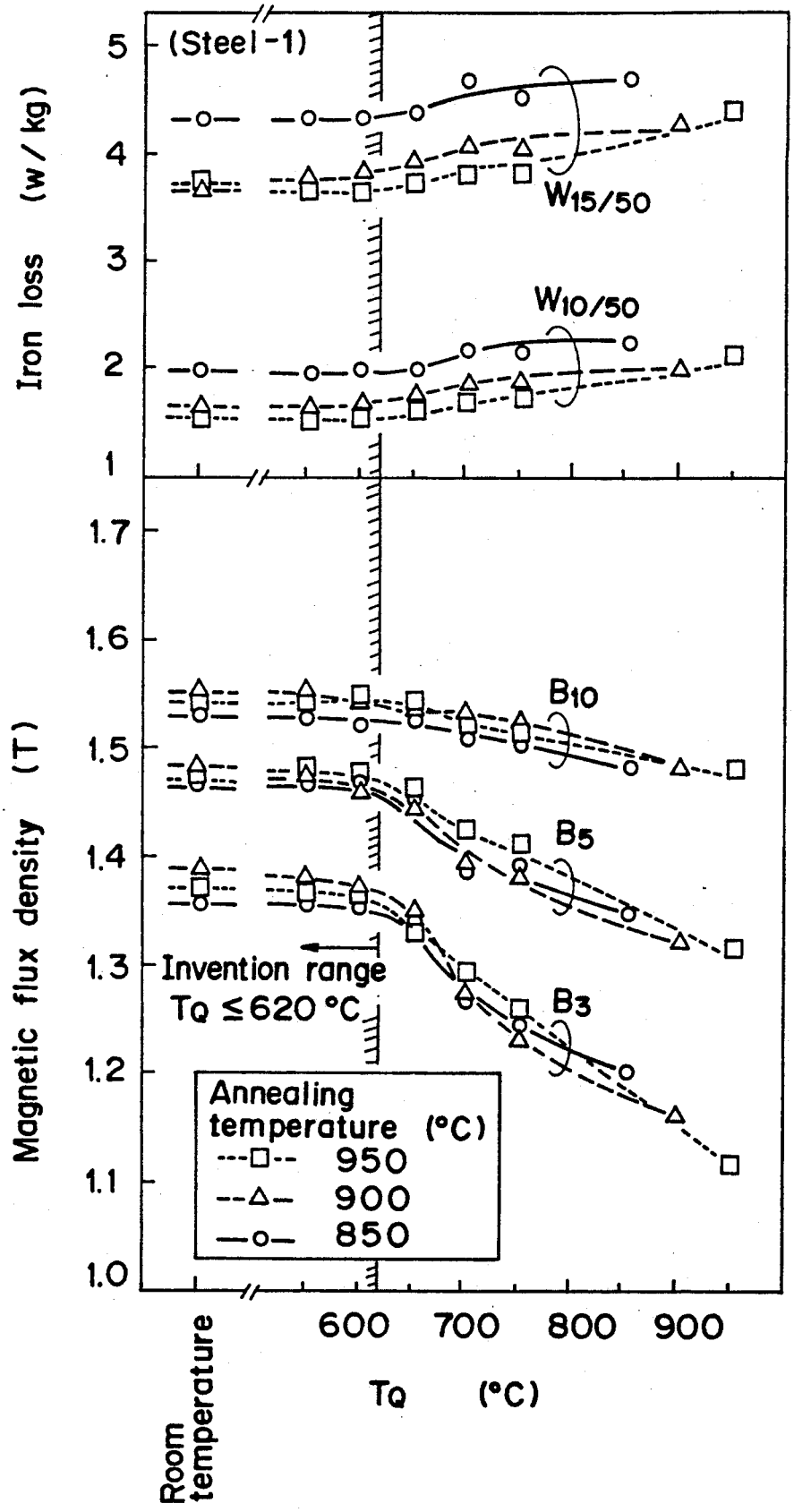
FIG. 3 shows influences of the cooling rate changing point $T_Q$ during cooling to the magnetic flux density in 1.7 wt % steel in the annealing line.
Figure 4:
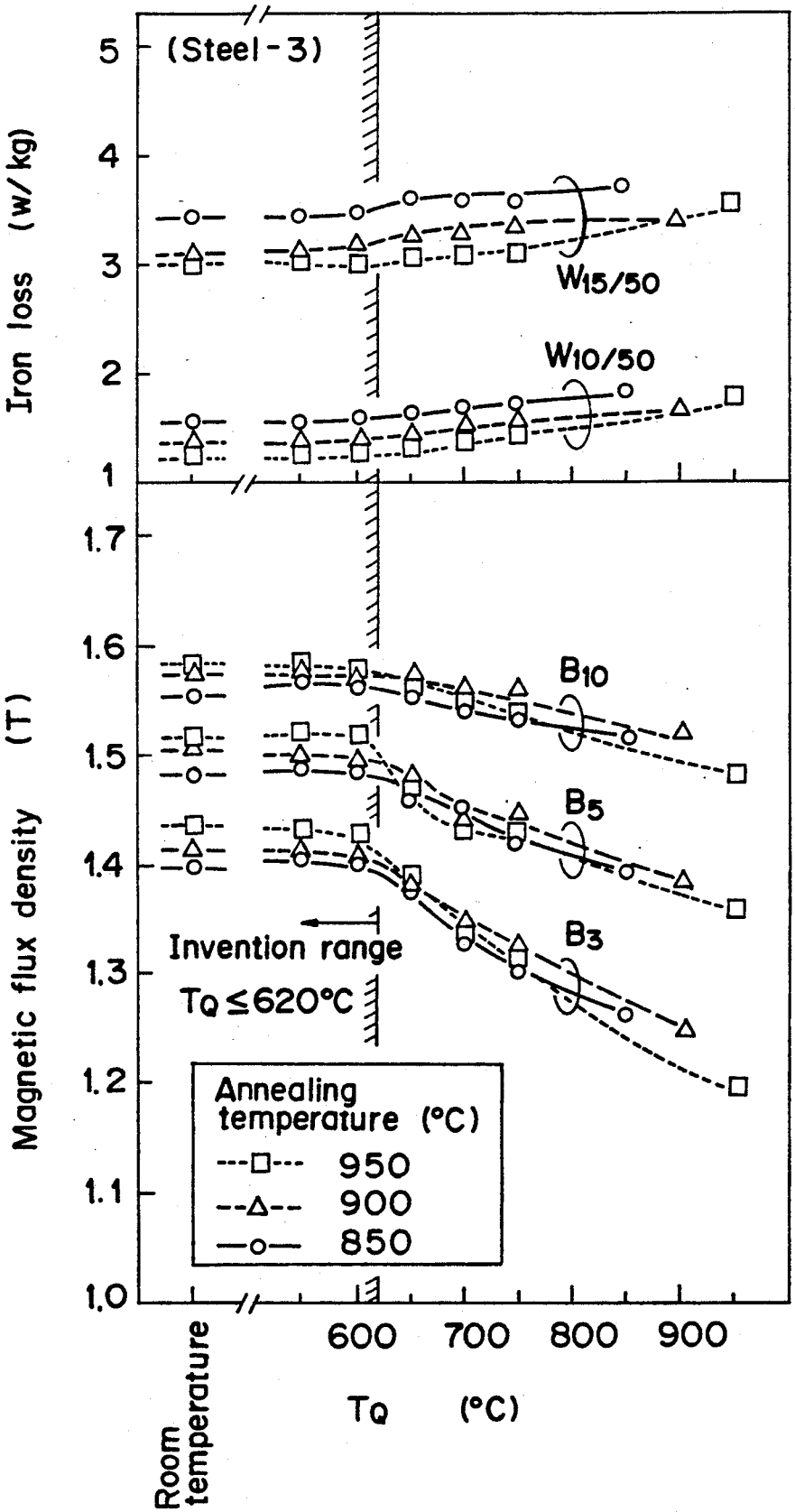
FIG. 4 shows influences of the cooling rate changing point $T_Q$ during cooling to the magnetic flux density in 3 wt % steel in the annealing line.

The deterioration of the magnetic properties caused by the internal stress markedly appears in the case of fast cooling from the temperature range of higher than 620°, and therefore the cooling of the invention is performed at the rate $v_1$ of not more than 8° C./sec from the soaking temperature to the temperature which is lower than 620° C. FIGS. 3 and 4 investigate the influences of the changing points $T_Q$ of the cooling rate from 5° C./sec to 20° C./sec during cooling in the annealing line on the magnetic flux density with respect to the same steels listed in FIGS. 1 and 2, and it is seen that the magnetic flux density is deteriorated when the changing point of the cooling rate becomes higher than 620° C., that is, when the cooling rate is changed to higher than 8° C./sec before reaching 620° C.

Although the cooling rate of below 8° C./sec could be continued in the temperature range of lower than 550° C., the magnetic properties under the low magnetic field are not much changed. Thus, maintaining such a cooling rate invites a decrease in productivity and a lengthening of the cooling zone. Therefore, the invention defines the cooling rate of not more than 8° C./sec as the temperature range between the soaking temperature and 620°-550° C., and with respect to lower ranges the invention performs the cooling at higher rates.

Figure 5:
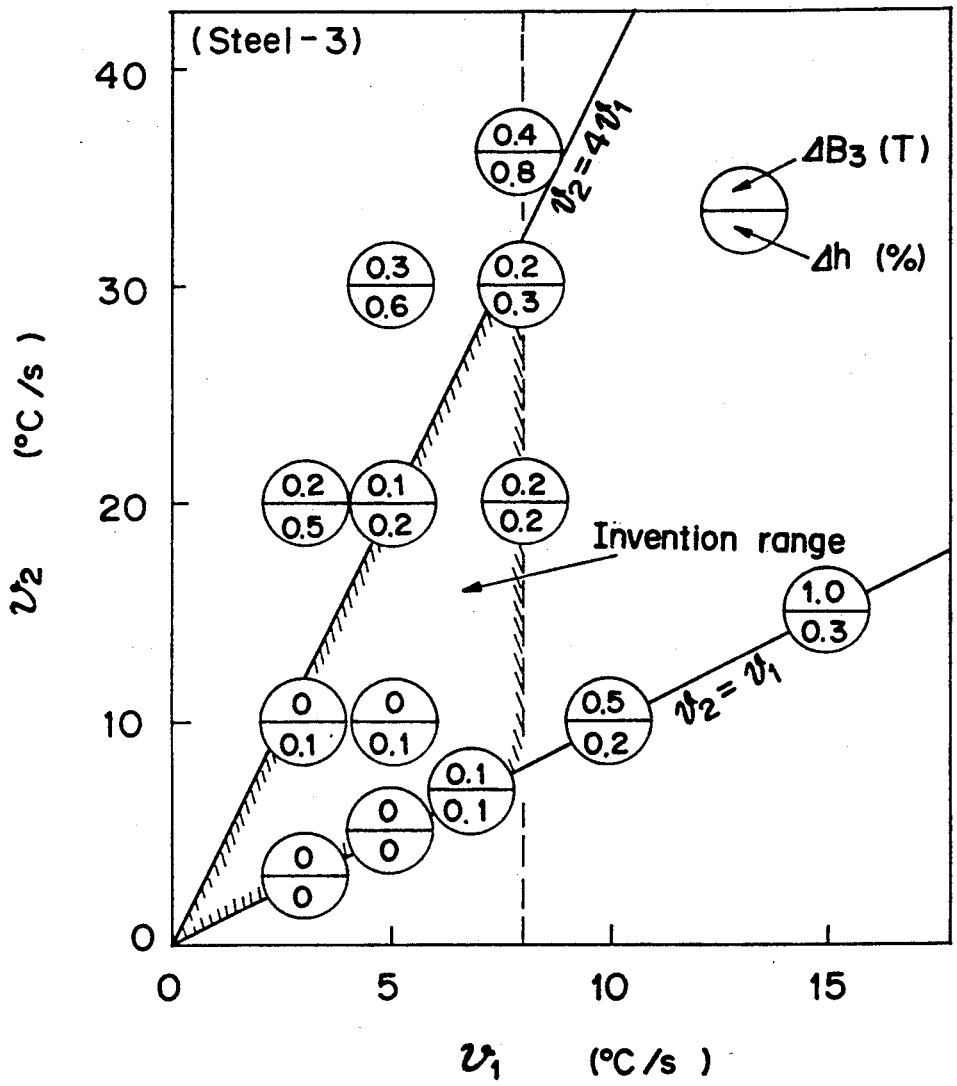
FIG. 5 Shows the optimum range of $v_1$ and $v_2$ in 3 wt % steel.

As for the temperature range below 550° C., the cooling rate of the gas jetting hardly affects the magnetic properties, but if the cooling rate is abruptly changed for the cooling rate $v_1$ which is from annealing temperature to 620°-550° C., the shape of the steel sheet is deformed badly. In order to avoid this, it is necessary to determine the average cooling rate $v_2$ from at least not more than 550° C. to 300° C. to be $v_2 \leqq 4v_1$, whereby the deformation of the sheet by the strain caused by the cooling rate changing falls within an allowable level. FIG. 5 shows the optimum ranges of $v_1$ and $v_2$ for the 3% Si steel (Steel-3 of Table 1), and at the range where $v_2$ exceeds $4v_1$, the changing amount of a steepness is very large, and the shape of the plate is badly deformed.

If the average cooling rate from the soaking temperature to 300° C. is less than 5° C./sec, effects of the invention could not be expected when taking the productivity and facility cost into consideration.

Reference now will be made to reasons for limiting the steel chemistry of the invention.

The amount of C should be not more than 0.004 wt % after the final annealing in view of magnetic aging. Accordingly, if this limit is exceeded, the decarburization must be operated in any of the annealing steps (e.g. the final annealing) after the hot rolling, and for a speedy decarburization the upper limit of C content should be controlled up to 0.02 wt % during the steel making process.

A Si content of less than 1.0 wt % cannot accomplish the desired low iron loss due to lowering of electrical resistivity, and if it is more than 4.0 wt %, the cold rolling will be difficult as a result of a shortage of ductility.

Al is added as normally, and if it is less than 0.01 wt %, AlN finely precipitates so that preferable grain growth could not be achieved during the final annealing, and Al of more than 2.0 wt % spoils the cold rolling property.

In the present invention, the cooling condition is optimized only to the limited high temperature range giving bad influences to the magnetic properties under the low magnetic field, thereby to effectively check the thermal stress which is introduced into the steel during cooling without spoiling the productivity. Consequently, it becomes possible to produce the non-oriented electrical steel sheets having excellent magnetic properties under the low magnetic field.

EXAMPLE

The hot rolled steel plates of the compositions of Table 1 were cold rolled, and the non-oriented electrical steel sheets were produced. The magnetic properties and the steepness of the products are shown in Table 2.

TABLE 1

| No. | C | Si | Mn | P | S | Sol. Al | (wt %) N |
|---|---|---|---|---|---|---|---|
| 1 | 0.0024 | 1.71 | 0.27 | 0.004 | 0.003 | 0.360 | 0.0019 |
| 2 | 0.016 | 1.65 | 0.21 | 0.012 | 0.003 | 0.310 | 0.0015 |
| 3 | 0.0029 | 3.07 | 0.23 | 0.004 | 0.004 | 0.510 | 0.0019 |

TABLE 2

| | | Annealing conditions | | | | | Magnetic properties | |
|---|---|---|---|---|---|---|---|---|
| No. | Processes | Heating (°C.) | $V_1$ (°C./sec) | TQ (°C.) ($V_1$-$V_2$) | $V_2$ (°C./sec) | Steepness (%) | $B_3$ (T) | $W_{15/50}$ (W/Kg) |
| 1 | Inv. pro. | 850 | 5 | 600 | 20 | 0.1 | 1.36 | 4.33 |
| | Com. pro. | 850 | 5 | 600 | 30 | 0.8 | 1.20 | 4.82 |
| | Com. pro. | 850 | 5 | 700 | 20 | 0.6 | 1.25 | 4.76 |
| | Com. pro. | 850 | 10 | 600 | 20 | 0.5 | 1.28 | 4.65 |
| | Inv. pro. | 900 | 8 | 600 | 30 | 0.3 | 1.38 | 3.92 |
| 2* | Inv. pro. | 900 | 8 | 600 | 20 | 0.2 | 1.40 | 4.04 |
| | Com. pro. | 900 | 10 | 700 | 20 | 1.0 | 1.15 | 4.87 |
| 3 | Inv. pro. | 950 | 5 | 600 | 20 | 0.1 | 1.43 | 3.01 |
| | Com. pro. | 950 | 5 | 600 | 30 | 0.9 | 1.29 | 4.34 |
| | Com. pro. | 950 | 5 | 700 | 20 | 0.6 | 1.31 | 4.05 |
| | Com. pro. | 950 | 15 | 600 | 20 | 0.8 | 1.19 | 4.77 |
| | Com. pro. | 950 | 10 | 700 | 30 | 0.4 | 1.30 | 4.13 |
| | Inv. pro. | 950 | 8 | 600 | 30 | 0.2 | 1.41 | 3.20 |
| | Com. pro. | 950 | 8 | 700 | 30 | 0.6 | 1.25 | 4.02 |

Note:
*Decarburization annealing of 850° C. × 3 min before soaking

INDUSTRIAL APPLICABILITY

The present invention is applied to the production of non-oriented electromagnetic steel sheets to be used in products requiring the property of low magnetic field such as iron cores of motors.

We claim:

1. A method of making non-oriented electrical steel sheets having excellent magnetic properties under low magnetic field, comprising carrying out one cold rolling or plural cold rollings having interposed therebetween an intermediate annealing on a silicon steel sheet to a final thickness, containing not more than 0.02 wt % carbon, 1.0 to 4.0 wt % silicon and, 0.01 to 2.0 wt % aluminum, a final continuous annealing at a temperature of 800° to 1100° C., and cooling under the following conditions:

(a) from a soaking temperature to a temperature range between 620° and 550° C., cooling at an average cooling rate $v_1$, wherein $v_1$ is not more than 8° C./sec;

(b) from said temperature range between 620° and 550° C. to a temperature of 300° C., cooling at an average cooling rate $v_2$, wherein $v_1 < v_2 \leqq 4v_1$;

with the proviso that the average cooling rate from said soaking temperature to 300° C. is more than 5° C./sec.

* * * * *